United States Patent [19]

Min

[11] 4,062,109

[45] Dec. 13, 1977

[54] FINGER-TOE NAIL CLIPPER PROVIDED FOR CATCHING AND HOLDING THE CLIPPED-OFF FINGER OR TOE NAIL PORTIONS

[76] Inventor: Manki Min, 45-22 39th Place, Sunnyside, N.Y. 11104

[21] Appl. No.: 680,377

[22] Filed: Apr. 26, 1976

[51] Int. Cl.[2] ..... A45D 29/02

[52] U.S. Cl. ..... 30/28

[58] Field of Search ..... 30/28, 124

[56] References Cited

U.S. PATENT DOCUMENTS

| | | | |
|---|---|---|---|
| 2,995,820 | 8/1961 | Pocoski | 30/28 |
| 3,154,850 | 11/1964 | Okuno | 30/28 |
| 3,188,737 | 6/1965 | Chase | 30/28 X |

*Primary Examiner*—Jimmy C. Peters

*Attorney, Agent, or Firm*—Clarence A. O'Brien; Harvey B. Jacobson

[57] ABSTRACT

An improved finger-toe nail clipper including the combination of a conventional finger or toe nail clipper and a receptacle removably receivable between the opposing sides of the forward nail clipping ends of the arms of the clipper and opening forwardly toward the opposing nail clipping edges of the clipper arms for catching and retaining the clipped-off finger or toe nail portions as desired.

5 Claims, 9 Drawing Figures

FINGER-TOE NAIL CLIPPER PROVIDED FOR CATCHING AND HOLDING THE CLIPPED-OFF FINGER OR TOE NAIL PORTIONS

BACKGROUND OF THE INVENTION

The modified conventional finger or toe nail clipper is provided with a pair of generally parallel hardened resilient steel strip members having front and rear ends and the front ends include laterally curved or straight inturned mating cutting edges in spaced-apart, face-to-face relationship while the rear ends of the strip members are secured together to permit the front ends and said cutting edges to be mover toward and away from each other.

Between the front ends of said strip members is defined a space for catching, holding and discharging the clipped-off finger or toe nail portions.

A round support post is disposed through the aligned apertures formed through in the forward portions of the strips near the cutting edges of the strip members and the post is provided with a round head at one end and means for hinging an operating lever at the other end, the operating lever being provided to apply a force to effect movement of the front ends, and thus the inturned mating offset cutting edges together.

Numerous clippers of this type have been previously patented and some have included structure for catching and releasably retaining clipped-off nail portions. However, few of these latter forms have been widely utilized because of inability to perform as desired, high cost of manufacture, adverse appearance, durability, reliability, and undue complexity, etc.

BRIEF DESCRIPTION OF THE INVENTION

The present invention relates to an improved finger-toe nail clipper and more particularly to a combining of various types of modified conventional finger or toe nail clippers and the provision of a receptacle to catch and hold the cut-off finger or toe nail portions and removable for emptying the receptacle.

This invention is well designed for satisfaction in the points of above-mentioned reasonable needs of utilizability.

In order to eliminate troublesome problems deriving from the using of previous conventional finger or toe nail clippers, the present invention is designed with simple construction, to be efficient and durable and comprises a practical device for catching, holding and sanitary discharging the severed finger or toe nail portions wherever it is used.

This invention is provided with an adapting receptacle or a housing member to be accommodated in the space between the front ends of the hardened resilient steel strips for catching and holding portions of the clipped-off finger or toe nail.

The principal object of the invention is to provide an improved finger-toe nail clipper including structure for catching and holding severed finger or toe nail portions until the clipped nail storage portion may be emptied in a desired receptacle, such as trash bags, garbage cans, or the like.

A further object of the invention is to provide a convenient handling means for the severed nail receptacle of the invention.

A further object of the invention is to provide means for sanitary discharging the accumulated severed nail portions by merely shifting the receptacle from its catching and holding position to its discharging position.

A further object is to provide a way of enjoying the same manner of the conventional finger or toe nail clippers by just setting the upturned rounded end of the elongated spring member of the receptacle into the short-lateral distance depression on the inside surface of upper said strip member.

Another object of this invention is to provide a simple room consisted of wall means to catch and hold the severed nail pieces.

Another object of this invention is to provide guide members thereof by merely enlarging downwardly a pair of opposing side walls of the receptacle to be overlapped the edge-like both side faces of one of said strip members to prevent it from separating in the mounted location, permitting slidable movement back and forth with the outside surfaces of said side walls provided with knurled surfaces for non-slip operation.

Still another object is to provide a receptacle adaptable to the varying intermediate space between a pair of said strip members when said cutting edges are in cutting motions.

In giving the above functions to the receptacle, one of the four walls of the receptacle is formed into rounded bottom including an elongated spring member extension to get spring function thereof; the spring member terminates in an upturned and rounded end of reduced width to be set in the short-lateral distance depression, whereby the receptacle may be selectively retained in operative and receptacle emptying positions.

Another object in the alternate embodiment of the invention is to provide a simple means for mounting the receptacle in said intermediate space between the strip members and enabling it to be readily removed from said space.

Still another object of this invention is to prove means to avoid deforming or breaking of the receptacle.

The various functions of aforesaid objects of this invention have been designed into only one member, a simple receptacle; this is the most important distinction in this invention.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
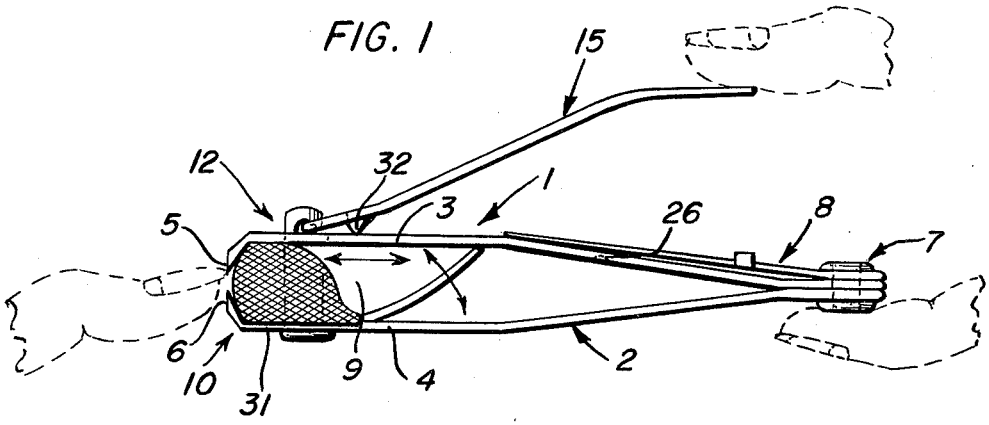
FIG. 1 is a front view of the invention in operation.
Figure 2:
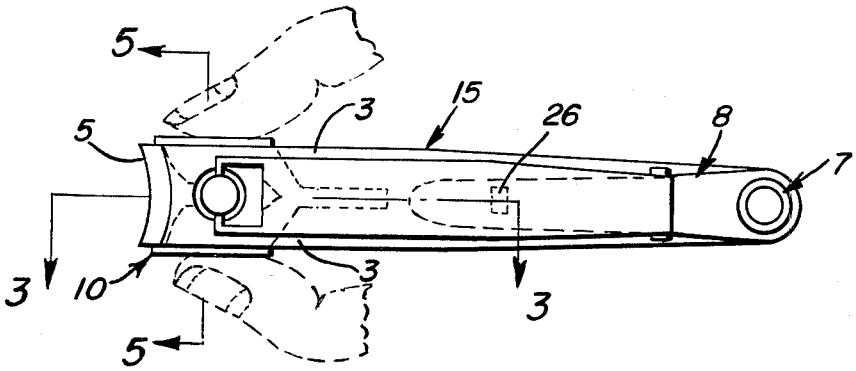
FIG. 2 is a top view of the invention showing two gripping fingers.
Figure 3:
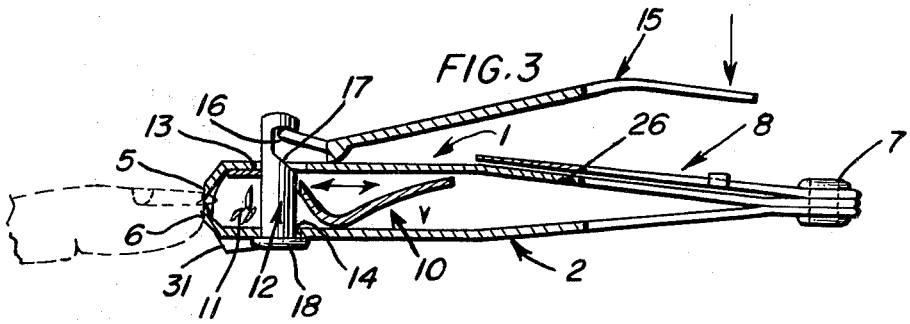
FIG. 3 is a front view of the invention partially in section taken along line 3—3 of FIG. 2, and view in the direction indicated by the arrows, showing accumulated severed nail portions and finger nail inserted between inturned mating cutting edges.
Figure 4:
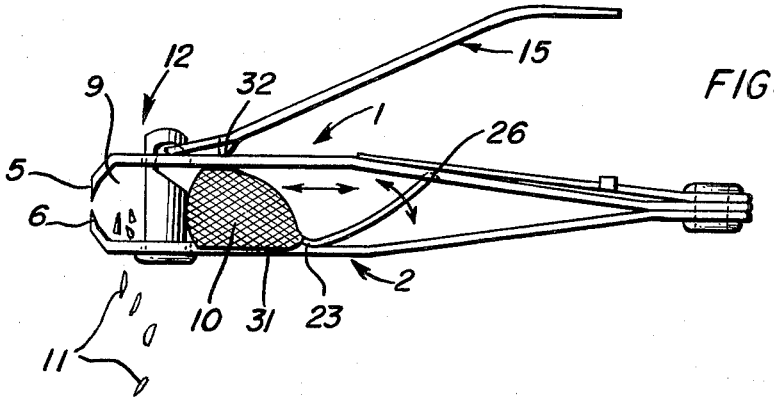
FIG. 4 is a front view of the invention with the receptacle set back in the discharging engagement position, showing the attitude of discharging the accumulated severed nail portions.

Referring to the drawings, the improved finger-toe nail clipper characterizing the present invention comprises a pair of hardened resilient steel strip members 1 and 2 having respectively both straight-line edges or side faces, 3, 3 and 4, 4 in front end portions, which are terminated into spaced-apart face-to-face off-set cutting edges 5 and 6, and the other end secured together by means of suitable means, preparing an end portion thereof, for hinge-like joint 7 with any needed accessory 8, and intermediate space 9 for disposing the receptacle 10 for catching, holding and discharging the cut-off finger or toe nail portions 11 from one to a certain amount of number of it 11 as desired.

A short round support post 12, which is disposed snugly and being journal through aligned two bores 13 and 14 opened respectively in the front portions of said strip members 1 and 2, interconnecting with the operating lever 15 to actuate said cutting edges 5 and 6, is provided with a top end 16 cutt-off like a hook-shape having downwardly sloped smooth surface 17 reduced in diameter to accommodate with said lever 15 and to receive the receptacle 10 respectively, and with a bottom end terminated in round head 18.

Now a remarkably well-designed member in this invention, a receptacle 10 formed basically with four hard resilient material wall members 19, 20, 21, and 22, from one of which a rounded bottom section 23 is formed and extended upwardly making elongated member 24 having spring function, terminating into upturned and rounded end 25 to be set in the short-lateral distance depression 26 on the inside surface of said strip member 1 when not in use and emptying the receptacle 10.

Figure 6:
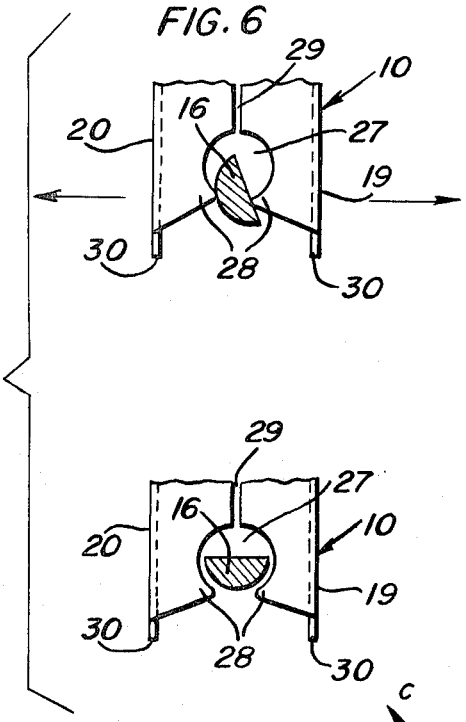
FIG. 6 is an explanatory figure showing the state of squeezing of the support post in the slot-like opening on the one wall member of the receptacle.

A wall member 21 is provided with a slot-like opening 27 to receive the cut-off portion 16 of said post 12, whereby the receptacle 10 is ready for catching and holding the cut-off finger or toe nail portions 11. Opening 27, having an entrance portion of less width than the diameter of said opening 27, is defined between a pair of rounded projection members 28 and 28 and ended in hole opening with a reasonable clearance for receiving the support post member 12. An elongated slot opening 29 in the wall member 22 being continuous with the slot-like opening 27 in the wall 21 is provided for protecting the receptacle 10, being given a spring function in cleavage displacement between said member 28 and 28, from deforming or break resulting from squeezing of the cut-off portion 16 of the support post member 12 in the entrance portion (between said projection members 28 and 28), as shown clearly in FIG. 6 upon the mislocating of the slot-like opening 27 to the cut-off portion 16 of the support post 12.

A knurled finger grip is defined on each outside surface of the wall members 19 and 20 and the latter include rounded edge portions 30 and 30 and define closure walls for the open sides of the space defined between the front ends of the strip members 1 and 2 including downward extensions 31 and 31 which slidably overlap the two edges 4 and 4 of the lower strip member 2.

The rounded portion 23 in the bottom section of the wall member 22 keeps always in contact with the front inside surface portion of said strip member 2, it being able to adapt the receptacle 10 itself to the variety of said space 9 defined with two strip members 1 and 2, consequently preparing a closed room or receptacle 10 to catch and hold the cut-off portions of finger or toe nail, not permitting any of them to be get out of it by itself.

With the receptacle 10 mounted in the defined space 9, the upturned and rounded end 25 of the elongated spring member 24 and the sections of the rounded projection members 28 and 28 are always keeping in contact with the inside surface of said strip member 1, while the round section 23 bears in contact with the front inside portion of said strip member 2 against the depressing force of aforesaid spring member 24 and projection members 28 and 28 therefrom. The range of stress of elongated spring member 24 should be covered enough to work therewith by using a special high resilient material, and giving a suitable length and shape of the elongated spring member 24.

Figure 8:
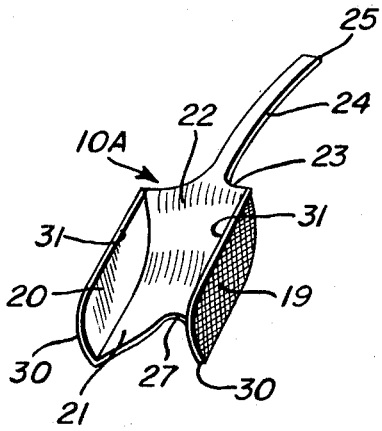
FIG. 8 is a pictorial view of a modified most important member, a receptacle, showing the hollowed inside.
Figure 9:
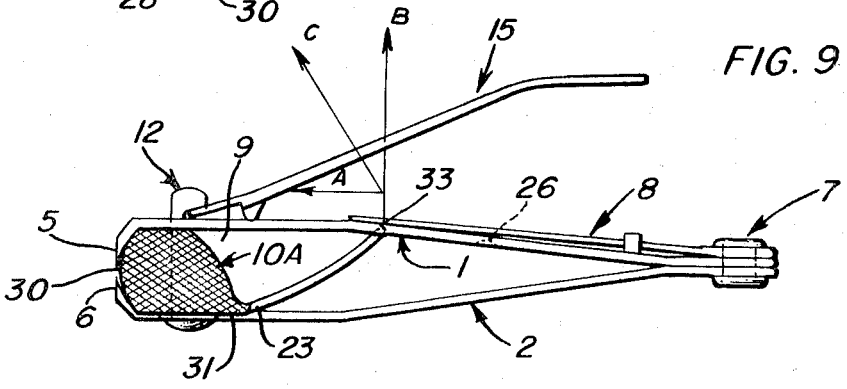
FIG. 9 is a longitudinal section view combined with the modified most important member, a receptacle indicating the vector diagram on the contact point of the end of elongated spring member with the front short-lateral distance depression.

In another slightly modified embodiment of the invention, an elongated slot opening 29 and a pair of rounded projection members 28 and 28 are eliminated, as shown in FIG. 8; another short-distance lateral depression 33 is provided on the inside surface of the section sloped downwardly of said strip member 1, to rest the end 25 consequently to engage the modified receptacle 10A, as shown in FIG. 9.

In FIG. 9, the component force "A" works to stay said receptacle 10A in catching and holding engagement without dislocation from its position.

Figure 5:
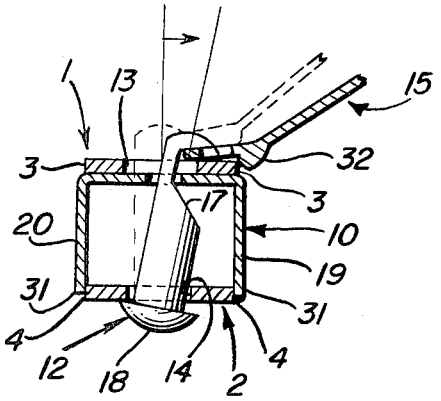
FIG. 5 is an enlarged sectional view of this invention taken substantially along line 5—5 of FIG. 2, and viewed in the direction indicated by the arrows with a part of operating lever turned to right angle position, illustrating the state of processing of the catching-holding engagement of the receptacle with gripping two fingers.
Figure 7:
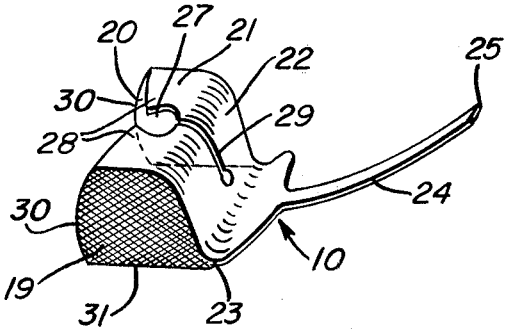
FIG. 7 is a pictorial view of the most important member, a receptacle, of the invention.

"C" is resultant force "VECTOR" causing from said spring member 24 and "A" and "B" are each component force "VECTOR" of said "C" "VECTOR". In operation, the operating lever 15 is turned to the transverse position (right angle position to the longitudinal center line), at this time fulcrum portion 32 slips down one edge 3 and two 3 and 3 in the front straight-line edge section of said strip member 1, as shown in FIG. 5, consequently drawing the cut-off portion 16 to the center position, as shown in FIG. 5, that is, from the dotted line position to the solid line position. Then, the knurled two wall members 19 and 20 are gripped with two fingers to draw the receptacle 10 forward overcoming the force of elongated spring member 24 to be removed from the set depression 26 until the receptacle is stopped by the cut-off portion 16 seated in said opening 27. Then, the lever 15 is returned to its longitudinal position. After repeating cutting action by pressing down and releasing the operating lever 15, the accumulated clipped-off finger or toe nail portions 11 may be disposed of by turning the operating lever 15 to either side of about right angle position and sliding back the receptacle 10 to its rest depression 26, after which the accumulated nail portions 11 may be deposited into the desired objects, such as, garbage can or trash bag, or the like.

In the modified receptacle 10A, the end 25 of the receptacle 10A is selectively receivable in forward depression 33 and backward depression 26. When depressing the operating lever 15, the cutting edges 5 and 6 are moved toward each other to clip off the finger or toe nails inserted between two edges 5 and 6, and the receptacle 10A defines a housing to catch and hold the clipped-off finger or toe nail portions.

Because the spring member 24 is always disposed under the state of depressing; and the end 25 is continueously in contact with the inside surface of said strip member 1, making the rounded bottom section 23 a fulcrum and the sections of the projection members 28 and 28 in contact with the inside front surface of said strip member 1 and slidably overlapped and extended sections 31 and 31 are movable down and up, respectively, keeping a slidable contact with said edges 4 and 4 in accordance with the movement of said strip member 1, and the spring function of said spring member 24 covers aforesaid variety of defined space 9.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. In combination, a nail clipper of the type including a pair of elongated horizontally disposed upper and lower spring material strip members including front and rear end portions and opposite longitudinal sides, said rear end portions being joined together and said front end portions being slightly divergent and spaced apart for movement toward and away from each other, the forward terminal ends of said upper and lower strip members including downturned and upturned cutting edges, respectively, opposing each other and extending transversely of said front end portions for cutting nail portions therebetween, an upstanding post anchored relative to the forward end position of said lower strip member and slidably received upwardly through a vertical opening provided therefor formed through the forward end portion of said upper strip member, an operating lever pivotally supported from the upper end of said post above and engageable with said upper strip member and swingable into and out of position operative to force said front end portions of said strips toward each other and thus bring said cutting edges into cutting engagement with each other, a receptacle for receiving cut nail portions, said receptacle including longitudinal opposite side walls, a top wall structure disposed between and anchored relative to the upper marginal edges of said side walls and a rear wall structure disposed between and anchored relative to the rear marginal edges of said side walls, whereby said receptacle opens forwardly and downwardly, said receptacle being received between the front end portions of said strip members immediately rearward of said cutting edges with said upper wall structure engaging the underside of said upper strip member and the lower marginal edges of said side walls projecting downwardly over the opposite longitudinal sides of said lower strip member, the forward marginal portion of said top wall structure including a central forwardly opening recess formed therein in which the opposing portion of said post is received, the lower marginal portion of said rear wall being abutted against the opposing upper surface portion of said lower strip member and including a rearwardly and upwardly inclined resilient leaf spring member whose upper rear end is abutted against the undersurface of said upper strip member centrally intermediate its opposite ends, the engagement of said lower marginal portion of said rear wall with said lower stip member defining a fulcrum point of engagement of said receptacle with said lower strip member and the engagement of said leaf spring member with the underside of said upper strip member serving to bias said receptacle about said fulcrum point to maintain said upper wall structure abutted against the underside of the forward end portion of said upper strip member.

2. The combination of claim 1 wherein the undersurface of said upper strip member includes longitudinally spaced downwardly opening and rear recesses formed therein in which the free end of said leaf spring is selectively engageable, said receptacle being slidably received between said strip member for longitudinal shifting relative thereto between forward and rearward active and inactive positions, respectively, with the free end of said leaf spring seated in said front and rear recesses, respectively.

3. The combination of claim 1 wherein said receptacle is slidably received between said strip members for longitudinal shifting relative thereto between forward and rearward active and inactive positions, respectively.

4. The combination of claim 1 wherein the forward portion of said central forwardly opening recess is wider than the diameter of the portion of said post seated in said forwardly opening recess.

5. The combination of claim 1 wherein the forward end of said recess includes a reduced width portion behind which said post is received and of a dimension less than the diameter of the portion of the post received in said recess as measured in a direction transversely of said strip members, said portion of said post including a reduced width as measured in a direction extending longitudinally of said strip members, said receptacle being angularly displaceable about said post approximately 90 degrees, whereby said portion of said post may pass through said reduced width portion of said recess.

* * * * *